United States Patent [19]

Greenleaf

[11] 3,934,893

[45] Jan. 27, 1976

[54] SLALOM SKI DEVICE

[76] Inventor: Joseph A. Greenleaf, 209 Village Drive, Lansing, Mich. 48910

[22] Filed: Oct. 4, 1974

[21] Appl. No.: 512,065

[52] U.S. Cl. ..... 280/11.35 K; 280/11.35 Y

[51] Int. Cl.[2] ..... A63C 9/00

[58] Field of Search .....280/11.35 Y, 11.35 K, 280/11.35 B, 11.35 D, 11.35 E, 11.35 A, 280/11.35 C, 11.35 H, 11.35 R; 9/310 AA, 9/310 A, 310 R, 310 B

[56] References Cited

UNITED STATES PATENTS

| | | | |
|---|---|---|---|
| 382,254 | 5/1888 | Conradson | 280/11.35 C |
| 2,984,497 | 5/1961 | Hagen | 280/11.35 R |
| 3,822,070 | 7/1974 | Salomon | 280/11.35 N |

FOREIGN PATENTS OR APPLICATIONS

| | | | |
|---|---|---|---|
| 388,834 | 6/1965 | Switzerland | 280/11.35 K |
| 207,506 | 3/1909 | Germany | 280/11.35 K |
| 470,189 | 5/1969 | Switzerland | 280/11.35 N |

*Primary Examiner*—Robert R. Song
*Assistant Examiner*—Milton L. Smith
*Attorney, Agent, or Firm*—Malcolm R. McKinnon

[57] ABSTRACT

A snow skiing device enabling the use of a single snow ski to support both feet of a skier for Alpine snow skiing and especially slalom snow skiing, the device including means providing a limited universal and automatically releasable connection between one of the skier's boots and the ski at a position disposed rearwardly of the skier's other boot which may be retained by a conventional automatically releasable binding. The limited universal and automatically releasable connection may also be adjusted longitudinally of the ski to meet physical and various skiing requirements of the skier.

13 Claims, 8 Drawing Figures

FIG. 1.
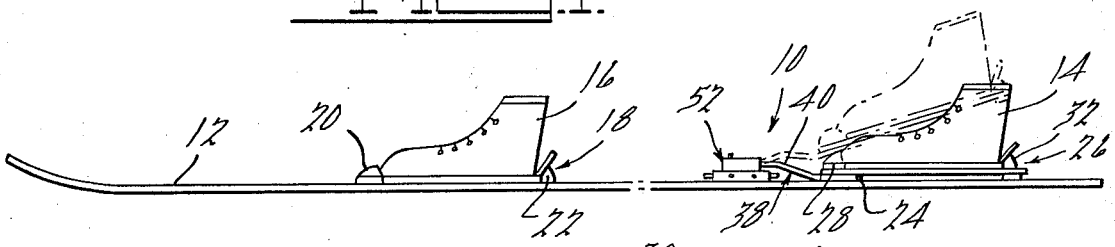
FIG. 2.
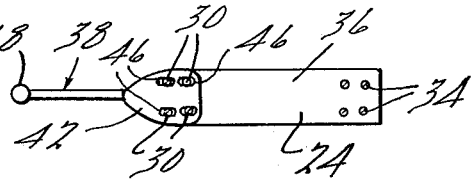
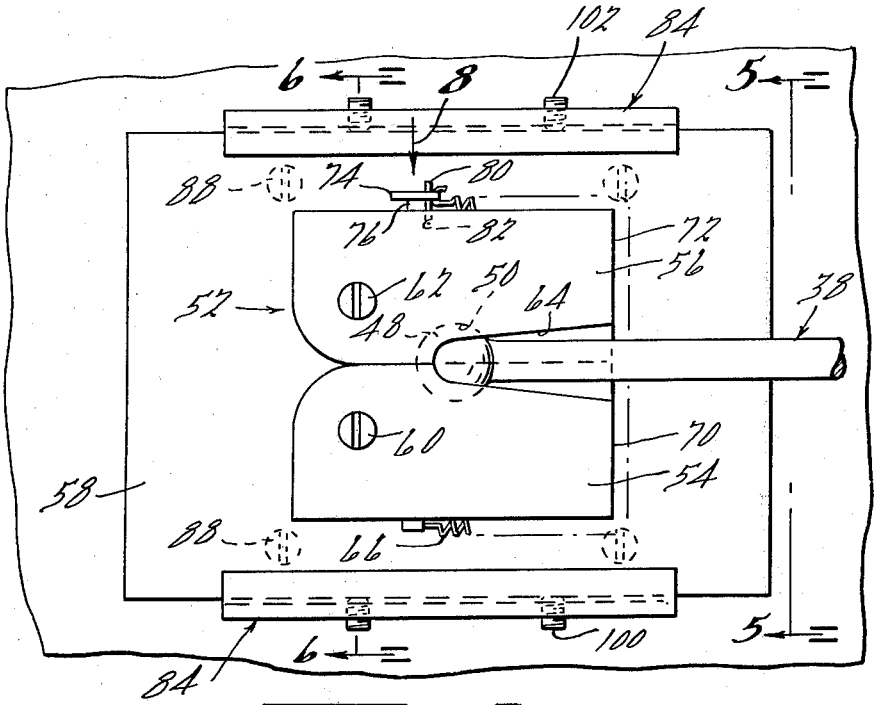
FIG. 3.
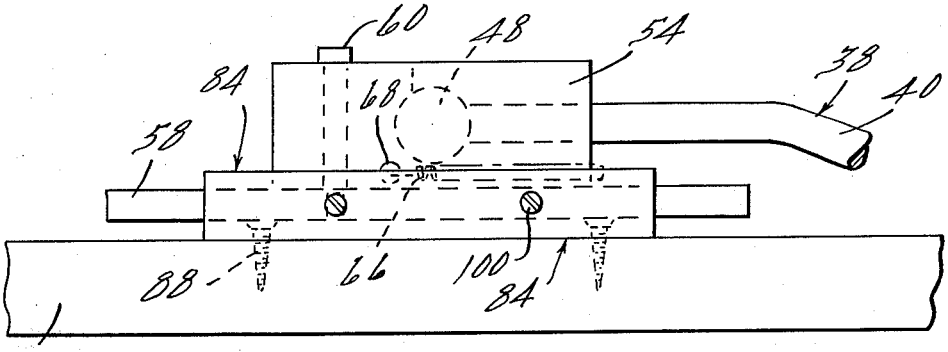
FIG. 4.

SLALOM SKI DEVICE

BRIEF SUMMARY OF THE INVENTION

This invention relates to snow skiing and, more particularly, to an improved snow skiing device enabling the use of a single snow ski to support both feet of a skier during Alpine skiing and especially slalom snow skiing.

Heretofore, is snow skiing, as distinguished from water skiing, the usual practice has been to utilize two skis for all types of Alpine snow skiing including slalom snow skiing. By way of constrast, in slalom water skiing, heretofore it has been common practice to utilize a single ski to support both feet of a water skier, the water skier's weak foot (that is to say, generally, the left foot for a right handed and/or right footed person described herein for explanatory purposes) being disposed approximately at the center of the ski and being secured to the ski both at the toe and at the heel of the water skier by means of a rubber or other resilient shoe. The strong foot, i.e., the right foot, as herein described, is supported on the same water ski behind the left foot and is secured to the water ski only at the toe by slipping the right foot into a resilient boot, not unlike a conventional bedroom slipper, whereby the right heel remains free and unrestrained. In slalom water skiing, the water skier maintains most of his or her weight on the left foot and utilizes the right foot for turning control. By way of example, if the water skier desires to change direction and turn to the right, he leans his body to the right and, using the left foot as a pivot point, pushes the right foot to the left making it act as a tiller. Left turns simply involve the reverse of such procedure. By using only a single ski, the water skier has more control than is provided when two skis are utilized and, at the same time, his mechanical advantage is increased by pushing or pulling the rear end portion of the single water ski rather than by attempting to turn the ski merely by pivotal action. Larger and stronger muscles can be utilized for pushing and pulling than can be utilized for pivoting, and at the same time, the total friction is reduced since only a single ski surface is in contact with the water. Moreover, since only one ski is utilized, there is no danger of ski cross-over which can cause a fall.

An object of the ivention is to provided an improved snow skiing device which enables a skier to utilize the above mentioned general principles of slalom water skiing.

Another object of the invention is to provide an improved snow skiing device which enables the use of a single snow ski to support both feet of a snow skier in all types of Alpine snow skiing and especially slalom snow skiing.

Another object of the invention is to provide an improved snow skiing device that increases the mechanical advantage that can be applied by a skier to a snow ski.

Another object of the invention is to provide an improved snow skiing device that increases the control and agility of a snow skier.

Another object of the invention is to provide an improved snow skiing device operable to automatically release the boot of a skier in the event of a fall or other emergency condition.

Another object of the invention is to provide an improved snow skiing device which is readily adjustable to suit the particular physical requirements of the skier and which is also readily adjustable for different types of snow skiing, such as slalom skiing and Telemark skiing.

Another object of the invention is to provide an improved snow skiing device that is economical and commercially feasible to manufacture and assemble, durable, efficient and reliable in operation.

Still another object of the invention is to provide an improved snow skiing device which may be utilized with conventional automatically releasable bindings and which may be readily attached to and removed from a conventional snow ski without damaging the ski or otherwise preventing its subsequent use with another ski for conventional dual skiing purposes.

The above as well as other objects and advantages of the present invention will become apparent from the following description, the appended claims and the accompanying drawings.

BRIEF DESCRIPTION OF THE DRAWINGS

FIG. 1 is a side-elevational view of a snow skiing device embodying the present invention, showing the same mounted on a conventional single snow ski and adapted to support one boot of the skier, together with a fragmentary side-elevational view of a conventional automatically releasable binding mounted on the same ski forwardly of the snow skiing device and adapted to releasably support the other boot of the skier;

FIG. 2 is a bottom plan view of a portion of the snow skiing device illustrated in FIG. 1;

FIG. 3 is a top plan view of another portion of the snow skiing device illustrated in FIG. 1;

FIG. 4 is a side-elevational view of the structure illustrated in FIG. 3;

DETAILED DESCRIPTION

Figure 5:
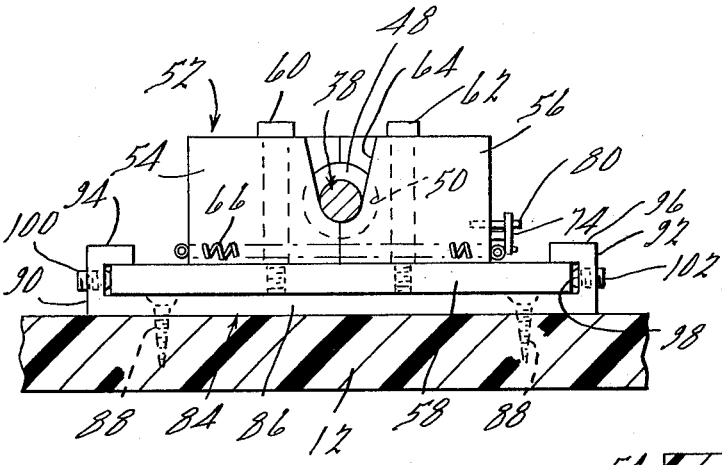
FIG. 5 is a transverse cross-sectional view of the structure illustrated in FIG. 3, taken on the line 5—5 thereof.

Referring to the drawings, a preferred embodiment of the invention is illustrated in FIGS. 1 through 8 thereof. The illustrated embodiment of the invention is comprised of a snow skiing device, generally designated 10, which is adapted to be mounted on a single conventional snow ski 12 and which is adapted to connect one boot 14 of a skier to the ski 12 for limited universal movement as will be described hereinafter in greater detail. As shown in FIG. 1 of the drawings, the skier's other boot 16 is mounted on the same ski 12 forwardly of the snow skiing device 10, the boot 16 being retained by a conventional automatically releasable binding, generally designated 18, which may be of any desired type and may include, for example, an automatically releasable toe piece 20 and an automatically releasable heel piece 22 effective to automatically release the boot 16 in the event of a fall or other emergency condition which might tend to injure the leg of the skier if the boot was not released from the ski 12. Such automatically releasable bindings are well know in the art and need not be described herein in greater detail.

Figure 8:
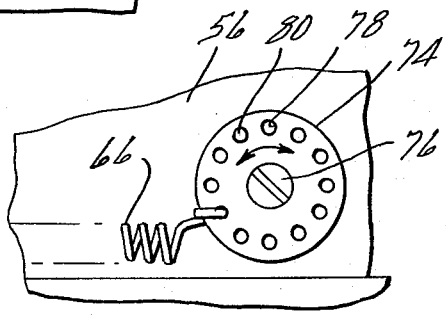
FIG. 8 is an enlarged elevational view of a portion of the adjusting mechanism embodied in the snow skiing device, looking in the direction of the arrow "8" in FIG. 3.

The snow skiing device 10 is comprised of a sole plate 24 which may be made of aluminum, steel or any other material having sufficient strength to withstand the forces exerted thereon and which is adapted to be clamped onto the boot 14 by means of a conventional automatically releasable binding, generally designated 26, which is similar to the releasable binding 18 and which may also be of any desired type well known in the art and include, for example, an automatically releasable toe piece 28 which may be fixed to the forward portion of the sole plate 24, as by screws 30, and an automatically releasable heel piece 32 fixed to the rear end portion of the sole plate by any desired or conventional means such as the screws 34. If desired, the bottom of the sole plate 24 may be provided with a non-skid surface 36 formed of corrugated rubber or other suitable non-skid material so as to provide traction in the snow when walking. An elongate toe stem, generally designated 38, is provided which may be made of aluminum, steel or any other suitable material having sufficient strength to withstand the forces exerted thereon and which is fixed to the forward end portion of the sole plate 24 so as to project forwardly therefrom, the toe stem 38 being bent upwardly, as at 40, to allow for walking ease. In the preferred embodiment of the invention illustrated, one end portion of the toe stem 38 is provided with an integral flange portion 42 which may be fixed to the sole plate 24 by the screws 30, the screws 30 passing through elongate slots 46 provided in the flange portion 42 and threadably engaging the sole plate 24. The slots 46 thus facilitate adjustment of the toe stem 38 relative to the sole plate 24. The other end portion of the toe stem 38 is provided with a ball 48 adapted to be inserted in a socket 50 defined by a support member, generally designated 52. In the preferred embodiment of the invention illustrated, the support member 52 is comprised of a pair of support elements 54 and 56 which are preferably made of nylon or other bearing material which will reduce the friction between the ball 48 and the surfaces of the bearing elements 54 and 56 defining the socket 50 when the ball is inserted in the socket. The support elements 54 and 56 are pivotally connected to a base plate 58, as by pivot pins 60 and 62. When the support elements 54 and 56 are disposed in the position illustrated in FIGS. 3, 4, 5 and 6, the support elements define the socket 50 which is open at the top but adapted to retain the ball 48 for limited universal movement. The support elements 54 and 56 also define a diverging passageway 64 which is open at the top and adapted to receive the toe stem 38. In the preferred embodiment of the invention illustrated, means is provided for releasably retaining the ball 48 in the socket 50 defined by the support elements 54 and 56, such means being comprised of an elongate tension spring 66, one end of which is fixed to the support element 54 as by a screw 68. The spring 66 passes around the ends 70 and 72 of the support elements 54 and 56, respectively, and the other end of the spring 66 is fixed to a rotatable wheel 74 mounted on a shaft 76 carried by the support element 56. The wheel 74 is provided with a plurality of angularly spaced holes 78, as illustrated in FIG. 8, adapted to receive a removable pin 80 which may be passed through one of the holes 78 and into a passageway 82 provided in the support element 56. With such a construction, the tension on the spring 66 may be adjusted to any desired value whereby the support elements 54 and 56 will retain the ball 48 in the socket 50 until the force exerted by the toe stem on the support member 52 exceeds the selected tension value after which the support elements 54 and 56 will pivot outwardly in opposite directions about the pivot pins 60 and 62 and release the ball 48 from the socket 50 when the force exerted on the support member 52 by the toe stem 38 exceeds the force exerted by the spring 66 tending to hold the support elements together in the ball retaining position illustrated in FIGS. 3, 4, 5 and 6.

Figure 6:
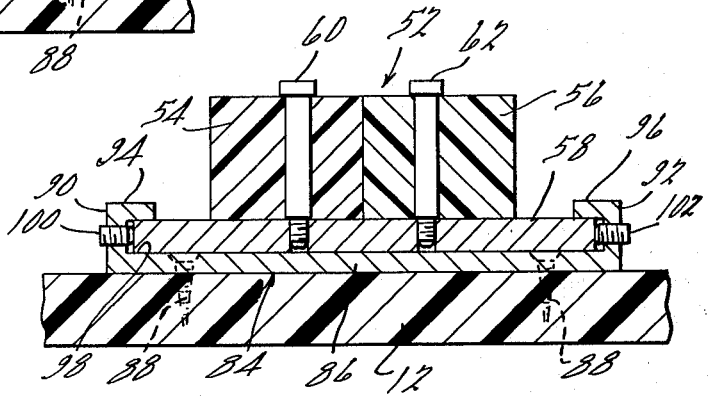
FIG. 6 is a transverse cross-sectional view of the structure illustrated in FIG. 3, taken on the line 6—6 thereof.
Figure 7:
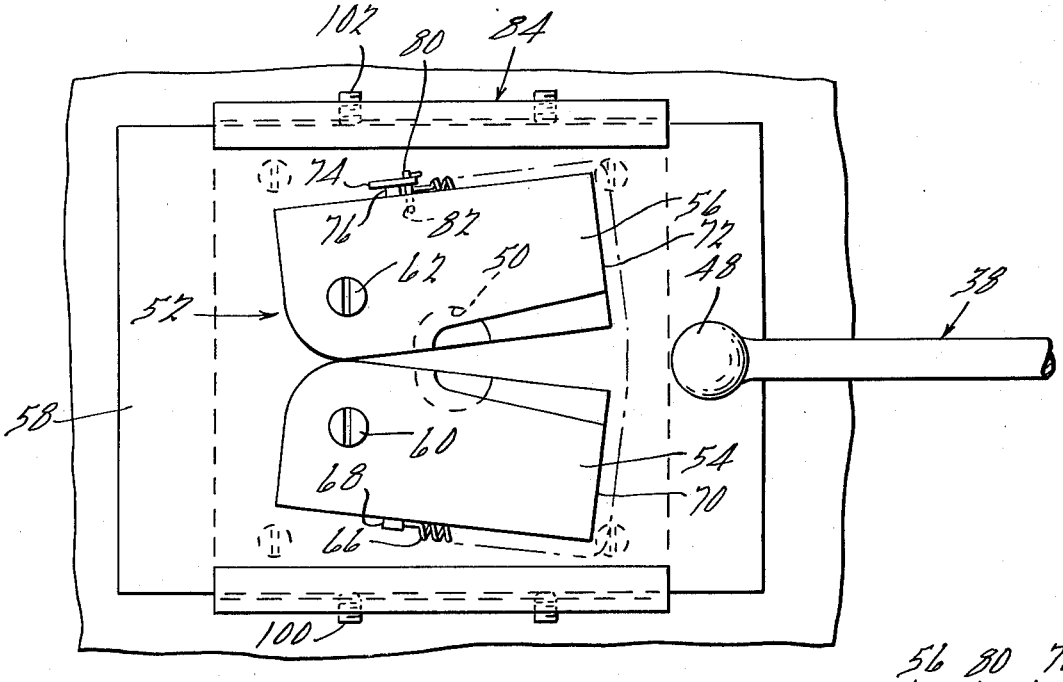
FIG. 7 is a top plan view of a portion of the snow skiing device illustrated in FIG. 1, showing the same prior to assembly thereof.

In the preferred embodiment of the invention illustrated, means is provided for adjusting the position of the support member 52 longitudinally of the ski 12 to suit the physical and other requirements of the skier. As shown in FIGS. 3, 4, 5, 6 and 7, the support plate 58 is mounted in an elongate, generally channel shaped track 84 which may be of any desired length and which may be made of aluminum, steel or any other material having sufficient strength to withstand the forces exerted thereon. The track 84 includes a web portion 86 which is secured to the ski 12, as by screws 88. The track 84 also includes integral upwardly projecting flange portions 90 and 92 and integral inwardly projecting flange portions 94 and 96, the track 84 thus defining an elongate channel 98 which is open at the top so that the support member 52 projects upwardly above the upper surfaces of the flange portions 94 and 96 as illustrated in FIGS. 4, 5 and 6. In the preferred embodiment of the invention illustrated, the base plate 58 is retained in the channel 98 defined by the track 84 by means of set screws 100 and 102 which threadably engage the flange portions 90 and 92 of the track 84 and the inner ends of which bear against the adjacent edges of the base plate 58. With such a construction, the base plate 58, which carries the support member 52, may be adjusted longitudinally of the track 84 to suit the particular requirements of the skier and retained in the selected, adjusted position by tightening the set screws 100 and 102. Obviously, other conventional means may be provided for retaining the base plate in the track 84.

In the operation of the ski device 10, the left boot 16 of the skier, as described herein, is secured to the ski 12 by means of the releasable binding 18 while the right boot 14 of the skier is secured to the sole plate 24 by means of the releasable binding 26. The ball 48 of the toe stem 38 is then inserted in the socket 50 by pushing the ball longitudinally of the passageway 64 into the socket 50, the pivotal connection of the support elements 54 and 56 to the base plate 58 permitting the ball 48 to pass longitudinally of the passageway 64 against the tension of the spring 66. In the rest position, the right boot can rest on the ski 12 as indicated in full lines in FIG. 1 of the drawings. With both feet on the ski 12, the skier, using his two ski poles, then pushes himself off to descend the hill. The skier then raises the right boot to the position illustrated in dotted lines in FIG. 1. If the skier desires to turn to the right, the skier utilizes the toe stem 38 to push the ball 48 to the left in the socket 50, thus forcing the rear of the ski to the left. The opposite motion is used for a left turn. The ski 12 can be angled or "edged" by turning the left foot and exerting pressure with the toe stem against the side of the socket 50 and exerting pressure with the toe stem against the side of the socket. Thus, by bearing down on the right side of the socket, the left side of the ski is raised, causing the right edge of the ski to bite into the snow or ice and providing improved control.

In Alpine slalom skiing, one object is to ski between zig-zag spaced flags which form "gates". Such action requires a great amount of sharp turning and with the ski device 10, such turns are simplified. For especially sharp turns, an upward pull by the right boot 14 will raise the rear or "tail" of the ski, making the left foot a true pivot point. For high speed skiing, the ski device 10 may be adjusted rearwardly on the ski in the manner previously described so as to increase the mechanical advantage of the skier. With the ski device 10 disposed rearwardly on th ski, the skier forms a "Telemark" position, his legs forming a greater angle than in slalom skiing and his center of gravity being lower thereby improving his balance. At the same time, his body is more streamlined thereby decreasing wind resistance and increasing speed.

It will also be appreciated that the ski device 10 facilitates skiing by one legged skiers having a suitable prosthetic leg adapted to carry either of the boots 14 or 16.

It will also be appreciated that the skier may rely upon the releasable bindings 26 connecting the boot 14 to the sole plate 24 and that the skier need not rely solely upon the releasable connection of the ball 48 in the socket 50 which permits the ball 48 to be released from the socket 50 when the forces exerted by the toe stem 38 on the support member 52 exceed the adjusted tension of the spring 66, and it will be understood that, if so desired, the ball 48 may be permanently mounted in the socket 50 as by simply screwing the support elements 54 and 56 together in which case the skier will rely upon the releasable bindings 26 to release the boot 14 from the sole plate 24 in the event of a fall or other emergency condition that might tend to injure the skier.

While a preferred embodiment of the invention has been illustrated and described, it will be understood that various changes and modifications may be made without departing from the spirit of the invention.

What is claimed is:

1. In a ski device, the combination including a planar sole plate, an elongate toe stem connected to and projecting longitudinally forwardly from said sole plate, a ball fixed to the free end portion of said toe stem, a planar base plate, a support member comprised of a pair of support elements each connected to said base plate for pivotal movement about an axis normal to the plane of said base plate, said support elements defining a socket adapted to receive said ball, said ball and socket connecting said toe stem to said support member for limited universal movement relative thereto.

2. The combination as set forth in claim 1, said toe stem projecting longitudinally from said sole plate and out of the plane of said sole plate whereby said ball is disposed out of the plane of said sole plate.

3. The combination as set forth in claim 1, and means threadably connecting said toe stem to said sole plate.

4. The combination as set forth in claim 1 including spring means resiliently restraining pivotal movement of said support elements relative to said base plate whereby said ball is releasably retained in the socket defined by said support elements.

5. The combination as set forth in claim 4 including means for adjusting the tension of said spring means.

6. In combination with a snow ski, a ski device including a planar sole plate, an elongate toe stem connected to and projecting longitudinally forwardly from said sole plate, a ball fixed to the free end portion of said toe stem, a planar base plate, a support member carried by said ski and comprised of a pair of support elements each connected to said base plate for pivotal movement about an axis normal to the plane of said base plate, said support elements defining a socket adapted to receive said ball, said ball and socket connecting said toe stem to said support member for limited universal movement relative thereto.

7. The combination as set forth in claim 6 including means adjustably connecting said base plate to said ski.

8. The combination as set forth in claim 7 including means for releasably connecting a ski boot to said sole plate.

9. The combination as set forth in claim 6 including an elongate track member fixed to said ski, and means adjustably connecting said base plate to said track member.

10. The combination as set forth in claim 9, said toe stem projecting longitudinally from said sole plate out of the plane of said sole plate whereby said ball is disposed out of the plane of said sole plate.

11. The combination as set forth in claim 10, and means threadably connecting said toe stem to said sole plate.

12. The combination as set forth in claim 11, said sole plate including a non-skid surface on the side thereof remote from said ball.

13. The combination as set forth in claim 10, said support member including adjustable resilient means resiliently restraining pivotal movement of said support elements relative to said base plate whereby said ball is releasably retained in the socket defined by said support elements.

* * * * *